US010159317B2

(12) United States Patent
O'Such

(10) Patent No.: US 10,159,317 B2
(45) Date of Patent: Dec. 25, 2018

(54) PERSONAL CARRYING BAG SUITABLE FOR CARRYING SHOES

(71) Applicant: Bekite LLC, Irvine, CA (US)

(72) Inventor: Beth O'Such, Laguna Hills, CA (US)

(73) Assignee: BEKITE LLC, Dallas, TX (US)

( * ) Notice: Subject to any disclaimer, the term of this patent is extended or adjusted under 35 U.S.C. 154(b) by 106 days.

(21) Appl. No.: 15/041,685

(22) Filed: Feb. 11, 2016

(65) Prior Publication Data

US 2017/0231341 A1 Aug. 17, 2017

(51) Int. Cl.

| | |
|---|---|
| ***A45C 3/12*** | (2006.01) |
| ***A45C 3/02*** | (2006.01) |
| ***A45C 13/02*** | (2006.01) |
| ***A45C 13/10*** | (2006.01) |
| ***A45C 13/30*** | (2006.01) |
| ***A45C 7/00*** | (2006.01) |

(52) U.S. Cl.

CPC ..... *A45C 3/12* (2013.01); *A45C 3/02* (2013.01); *A45C 7/0086* (2013.01); *A45C 13/02* (2013.01); *A45C 13/10* (2013.01); *A45C 13/30* (2013.01); *A45C 2013/306* (2013.01)

(58) Field of Classification Search

CPC .. A45C 3/12; A45C 3/02; A45C 13/02; A45C 13/10; A45C 2013/306

See application file for complete search history.

(56) References Cited

U.S. PATENT DOCUMENTS

| | | | | |
|---|---|---|---|---|
| 791,912 A * | 6/1905 | Jackson | ..... | 206/459.5 |
| 1,921,110 A | 8/1933 | Wheary | | |
| 2,634,835 A | 4/1953 | Mayers | | |
| 2,874,813 A | 2/1959 | Bunte | | |
| 3,110,376 A | 11/1963 | Naab et al. | | |
| 3,327,924 A | 6/1967 | Brutting | | |
| 3,749,233 A * | 7/1973 | McCormick, Jr. | ..... | A45C 11/26 206/373 |
| 5,096,030 A | 3/1992 | Espinosa et al. | | |
| 5,370,230 A | 12/1994 | Cox | | |
| 6,145,659 A | 11/2000 | Faircloth et al. | | |

(Continued)

FOREIGN PATENT DOCUMENTS

| | | |
|---|---|---|
| GB | 2270898 | 3/1994 |
| WO | 2007001271 | 1/2007 |

OTHER PUBLICATIONS

Google Search "bag recycled seat-belt", search date Dec. 18, 2017 for image before Dec. 6, 2016.*

(Continued)

*Primary Examiner* — Tri Mai

(74) *Attorney, Agent, or Firm* — Jose Gutman; Fleit Gibbons Gutman Bongini & Bianco P.L.

(57) ABSTRACT

A personal shoe bag includes a main body having at least two protective shoe zones configured to receive and carry respective two personal shoes. Each protective shoe zone includes a wall with an image of a shoe visually indicating where to place, and how to orient, each of the two personal shoes. A first example shoe bag includes a single strap for a user to carry the shoe bag. A second example shoe bag includes two straps with a clip at the end of each strap. The clip can be removably attached to another separate personal carrying bag to facilitate carrying the shoe bag along with the other separate personal carrying bag.

10 Claims, 4 Drawing Sheets

(56) References Cited

U.S. PATENT DOCUMENTS

| | | | | |
|---|---|---|---|---|
| 6,269,991 | B1 * | 8/2001 | Hood | A45C 13/30 224/258 |
| D679,090 | S * | 4/2013 | Du | D3/279 |
| D762,385 | S * | 8/2016 | Horner | D3/285 |
| 2003/0057118 | A1 | 3/2003 | Coppedge et al. | |
| 2007/0000796 | A1 * | 1/2007 | Kameoka | A45C 3/12 206/278 |
| 2011/0094907 | A1 | 4/2011 | Meynard | |
| 2011/0146856 | A1 | 6/2011 | Vancelette | |
| 2011/0147152 | A1 | 6/2011 | Abdill | |
| 2013/0092570 | A1 * | 4/2013 | Middleton | A45C 3/12 206/292 |
| 2013/0270132 | A1 | 10/2013 | Meynard | |

OTHER PUBLICATIONS

Amazon, "eBags Shoe Shoe Bag", downloaded from http://www.Amazon.com/eBags on May 11, 2016, pp. 1.

International Search Report issued for App. No. PCT/US2017/016824 dated Apr. 13, 2017.

International Preliminary Report on Patentability issued for App. No. PCT/US2017/016824 dated Apr. 13, 2017.

* cited by examiner

PERSONAL CARRYING BAG SUITABLE FOR CARRYING SHOES

FIELD OF THE DISCLOSURE

The present disclosure generally relates to carrying bags, and more particularly to a personal carrying bag suitable for carrying shoes.

BACKGROUND

Wearing a clean and aesthetically pleasing pair of shoes is important to many people, such as professionals and fashion-conscious individuals. Unfortunately, when one wears shoes outside, e.g., commuting to-from work, the shoes often become dirty, marred, scratched, and discolored. The shoes are unsightly and potentially unwearable indoors, e.g., at the office.

Many people wear one pair of shoes for their commute to work and then change into another pair of shoes once they arrive to their destination, such as to the office or other workplace. Reasons for this practice include 1) a desire to maintain comfortable footwear and protection against inclement weather while commuting wearing a suitable pair of shoes, and 2) protection of one's personal shoes to be worn at work while commuting to work with separate footwear. In the past, there has been no personal carrying bag designed to transport shoes in a secure and protective way, such as for a commuter. There are bags designed to carry shoes for very specific applications such as golf or shoe bags intended to fit inside luggage. Neither of these types of bags would be appropriate for many occasions such as for use by daily commuters as discussed above.

BRIEF DESCRIPTION OF THE DRAWINGS

The accompanying figures in which like reference numerals refer to identical or functionally similar elements throughout the separate views, and which together with the detailed description below are incorporated in and form part of the specification, serve to further illustrate various embodiments and to explain various principles and advantages all in accordance with the present disclosure, in which.

DETAILED DESCRIPTION

As required, detailed embodiments will be disclosed herein; however, it is to be understood that the disclosed embodiments are merely examples and that the devices, structures and methods described herein can be embodied in various forms. Therefore, specific structural and functional details disclosed herein are not limiting, but merely as a basis for the claims and as a representative basis for teaching one of ordinary skill in the art to variously employ the disclosed subject matter in virtually any appropriately detailed structure and function. Further, it is intended that the terms and phrases used herein be non-limiting, and provide an understandable description. Additionally, unless otherwise specifically expressed herein or clearly understood from the context of use, a term as used herein describes the singular and/or the plural of that term.

Figure 1:
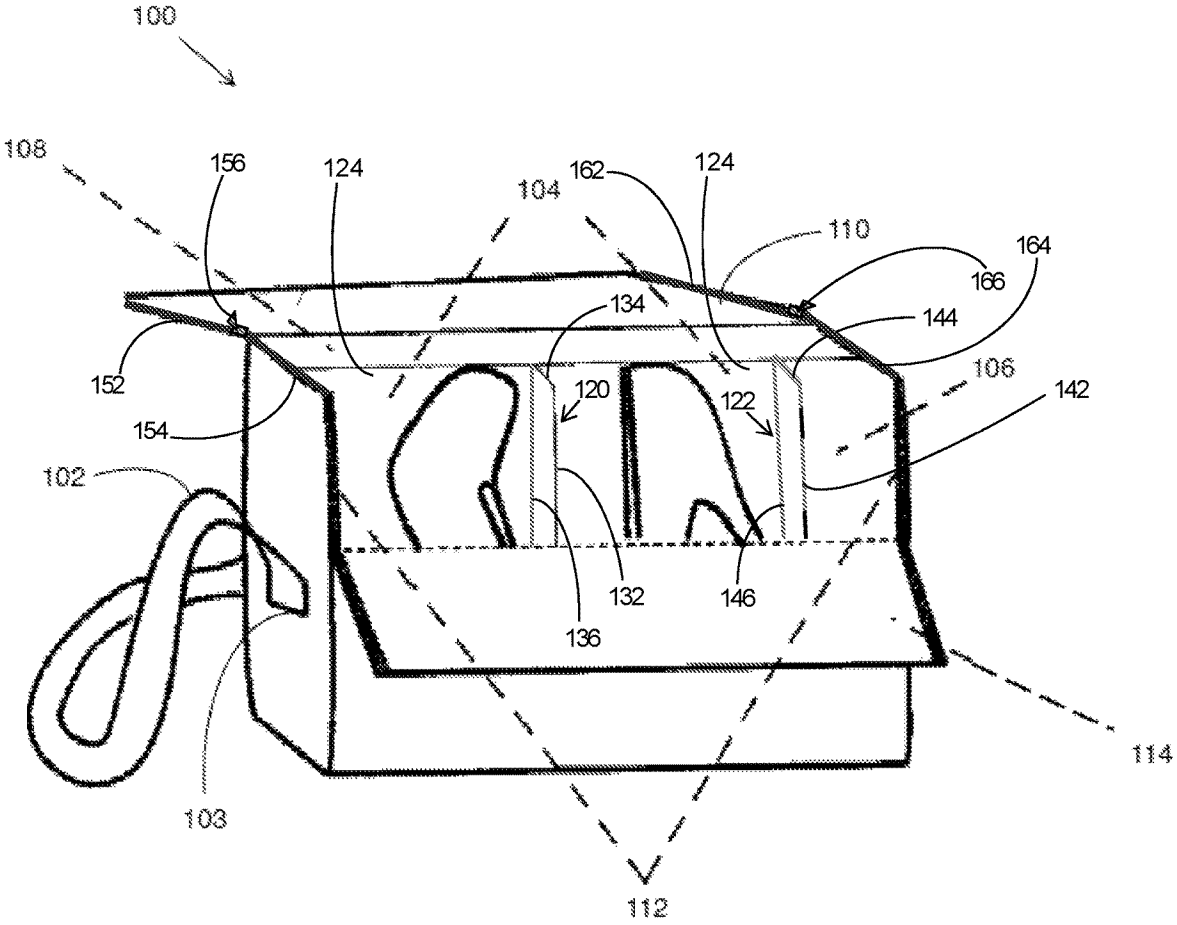
FIG. 1 is a front-side view of an example of a shoe bag with additional pockets for providing greater functionality to a user, according to various embodiments of the present disclosure.

As shown in FIG. 1, an example of a personal carrying bag 100 is particularly suited for carrying a pair of personal shoes. Such a personal carrying bag can also be referred to herein as a shoe bag. This shoe bag 100 includes at least one carrying strap 102 with first end and second end being attached to at least one side of the shoe bag 100 such as by stitching 103 or other attachment mechanism. The shoe bag strap, according to certain embodiments, comprises repurposed automobile seat-belt webbing fabric material, or any other suitable material (e.g., leather, cloth, etc.). For example, a seat-belt webbing fabric material can include any one of 7-panel webbing fabric, 3-panel webbing fabric, or 4-panel webbing fabric. The inside of the shoe bag main body includes protective shoe zones 104 which are separated from other compartments in the shoe bag 100 by walls that help protect the shoes carried in the protective shoe zones 104. According to one example, the inner walls in the protective shoe zones have wall surfaces made of soft material that reduce a possibility of scratching or marring shoes stored therein. For example, the inner wall surfaces may comprise any one or more of the following: felt, cotton, real or faux fur, leather, or the like.

Each of the protective shoe zones 104, according to the present example, includes an image of a shoe affixed to an inner wall of each protective shoe zone 104. While the image of a shoe will be discussed in the examples below as being printed, it should be understood that other methods of creating and/or forming the image of a shoe on an inner wall of each protective shoe zone 104 is contemplated according to various embodiments of the present disclosure. For example, an image of a shoe may be affixed on separate material that is then sewn onto the inner wall of each protective shoe zone 104. Other mechanisms for affixing the image of a shoe on the inner wall of the protective shoe zone 104 may be utilized, such as, but not limited to, painting, silk-screening, stamping, embossing, etc. A printed image of a shoe on the wall of the protective shoe zone indicates to a user that a shoe is to be carried in that particular protective shoe zone. Additionally, according to certain embodiments, the printed image of a shoe shows a suggested orientation for the shoe that would be located in the particular protective shoe zone 104.

According to the present example, a separate compartment 106 in the shoe bag 100 can carry accessories. Continuing with the example, a larger pocket compartment 108 can carry other larger items, such as items that a commuter might carry. These items could include a laptop computer, a tablet PC, a Smartphone, books, notebooks, and other supplies.

The front of the shoe bag 100, according to the example, has a zippered flap 114 which folds halfway down its' height to allow easy access to the inside of the shoe bag 100. One or more zippers 112 can be located along the edge(s) of the folding front flap 114 and along a folding top flap 110, which can attach the front flap 114 and/or the top flap 110 to the edges of the shoe bag 100. For example, as shown in FIG. 1, a first zipper portion 152 along one or more edges of the folding top flap 110 can mate with a corresponding second zipper portion 154 along one or more edges of the shoe bag 200. A first zipper attachment mechanism 156 facilitates the attachment/detachment of the first zipper portion 152 to/from the second zipper portion 154. In similar arrangement and operation, there can be a third zipper portion 162 along one or more edges of the folding top flap 110 that can mate with a corresponding fourth zipper portion 164 along one or more edges of the shoe bag 200. A second zipper attachment mechanism 166 facilitates the attachment/detachment of the third zipper portion 162 to/from the fourth zipper portion 164. When the flaps 114, 110, are attached along the zippered edges of the shoe bag 100, the shoe bag 100 is securely closed and the contents of the shoe bag 100, including shoes stored in the protective shoe zones 104 and any other items stored in the other compartments 106, 108, are enclosed and protected inside the shoe bag 100.

According to the example shown in FIG. 1, first vertically positioned shoe compartment divider 120 and a second vertically positioned shoe compartment divider 122 extend frontward from a large compartment divider 124 that separates the large compartment 108 from the two shoe compartments 104. A front edge 132 of the first vertically positioned shoe compartment divider 120 and a front edge 142 of the second vertically positioned shoe compartment divider 122 are in contact with an inner side of the front zippered flap 114 when in a closed position at the front side of the shoe bag 100. A top edge 134 of the first vertically positioned shoe compartment divider 120 and a top edge 144 of the second vertically positioned shoe compartment divider 122 are in contact with an inner side of the top zippered flap 110 when in a closed position at the top side of the shoe bag 100. A rear edge 136 of the first vertically positioned shoe compartment divider 120 and a rear edge 146 of the second vertically positioned shoe compartment divider 122 are in contact with the large compartment divider 124. The corner where the front edge 132 and the top edge 134 meet, contacts both the inner side of the front zippered flap 114 when in the closed position at the front side of the shoe bag 100 and the inner side of the top zippered flap 110 when in a closed position at the top side of the shoe bag 100.

While the discussion above described an example attaching the edges of the flaps 110, 114, with the corresponding edges of the shoe bag 100 using zippers, it should be understood that other attachment mechanisms could similarly be used in place of the one or more zippers. For example, one or more hook-and-loop strips can be located along one or more edges of each of the flaps 110, 114, and can mate with corresponding hook-and-loop strips located along one or more edges of the shoe bag 100. As another example, snaps could be located along the one or more edges of the flaps 110, 114, which would mate with corresponding mating snaps located along the one or more edges of the shoe bag 100. That is, each of the snaps along the edges of the flaps 110, 114, can mate with a corresponding snap along the one or more edges of the shoe bag 100, thereby securely closing the shoe bag 100.

Figure 2:
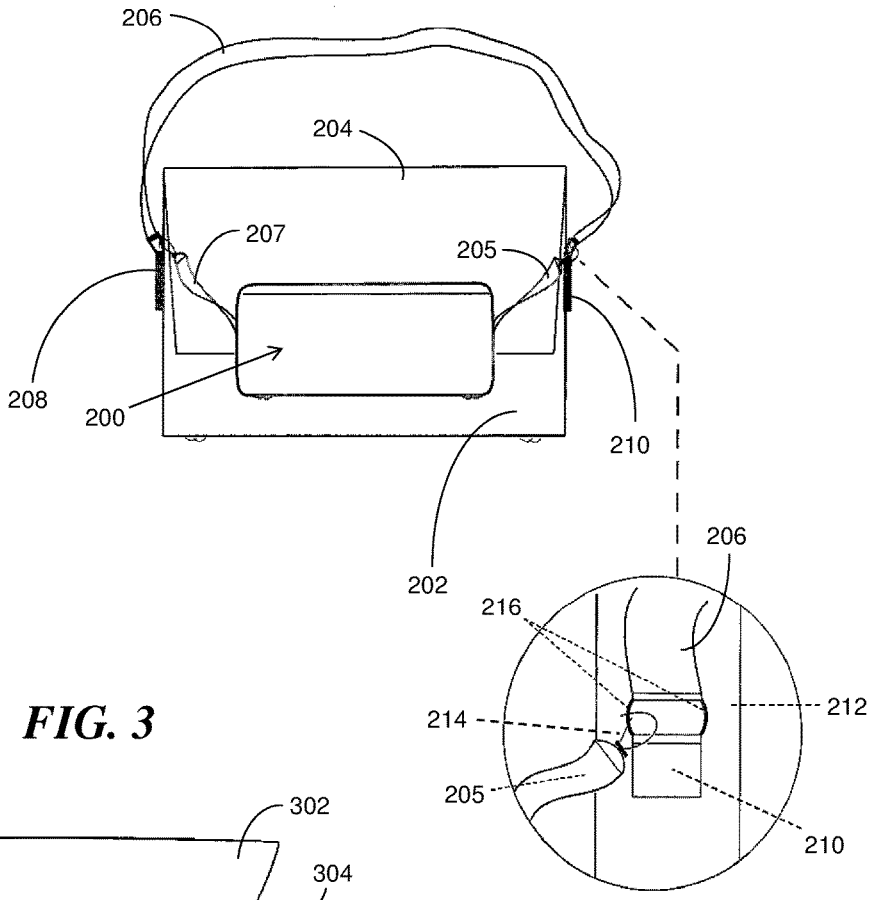
FIG. 2 is a perspective view of an example of a shoe bag that attaches to the front of a user's existing bag/briefcase, and with an enlarged view of a region in which the shoe bag is attached to the existing bag/briefcase, according to various embodiments of the present disclosure.

FIG. 2 illustrates an example of a shoe bag 200 according to various embodiments of the present disclosure. According to this example, the shoe bag 200 can attach to a user's existing bag or brief case 202. The shoe bag 200 includes first 205 and second 207 straps that, in this example, are attached to the shoe bag 200 at opposing outer sides of the shoe bag 200. The straps 205, 207 according one example comprise repurposed automobile seat-belt webbing fabric material, or any other suitable material (e.g., leather, cloth, etc.). The distal ends of the straps 205, 207, include a clip, such as the clip 214 shown attached to the one end 210 of the strap 206. This clip 214 can be easily attached to (and easily detached from) the ends 208, 210, of the strap 206 of the existing bag or brief case 202.

As shown in the enlarged view in FIG. 2, one end 210 of the strap 206 is attached to a side 212 of the existing bag or briefcase 202, such as by stitching the end 210 to the side 212 of the existing bag or briefcase 202. The clip 214 attaches the strap 205 from the shoe bag 200 to a mechanical feature 216 of attachment hardware used at the end portion 210 of the strap 206 of the existing bag or briefcase 202.

It is common to add attachment hardware to the ends 208, 210, of the strap 206, such as an attachment metal loop 216 to which the end 210 of the strap 206 is attached and which the end 210 also is attached directly, e.g., sewn onto, the side 212 of the bag or brief case 202. The strap 206 is moveably attached to the side 212 of the existing bag or brief case 202 by using this attachment hardware 216, such as a metal ring. The attachment hardware 216 provides a decorative metal reinforcement to the end 210 of the strap 206 attached to the side 212 of the existing bag or brief case 202 while allowing the strap 206 to move (e.g., swivel) more freely relative to the sewn end 210 of the strap 206. This attachment hardware 216 often includes metal features 216 of the attachment hardware that are separate from the side of the bag 212 and provide a convenient structure onto which can be attached the clip 214 of the particular strap 205 of the shoe bag 200. While the attachment hardware 216 shown in this example comprises a metal ring 216, other attachment hardware and feature arrangements may be equally suitable for attaching the clip 214 of the particular strap 205 of the shoe bag 200.

The existing bag or briefcase 202, in this example, includes a top cover flap 204 that typically includes a locking mechanism (not shown) to lock the distal end of the top cover flap 204 to the rest of the body of the bag or brief case 202. Typically, this locking mechanism attached at the front side of the existing bag or briefcase 202. While the shoe bag 200 is shown attached and resting on the front side of the existing bag or briefcase 202, the shoe bag 200 can similarly be attached to the existing bag or brief case 202 while located adjacent to the backside of the existing bag or brief case 202.

The shoe bag 200 is easily attached to the ends 208, 210 of the strap 206, and thereby conveniently carried along with the existing bag or briefcase 202 while a user hangs the strap 206 of the existing bag or briefcase 202, for example, onto a shoulder. Optionally, the bag or briefcase 202 includes a handle (not shown) along a top edge of the top cover flap 204 and/or a handle (not shown) on the strap 206, which can be used to carry both the existing bag or briefcase 202 and the shoe bag 200 attached thereto.

Figure 3:
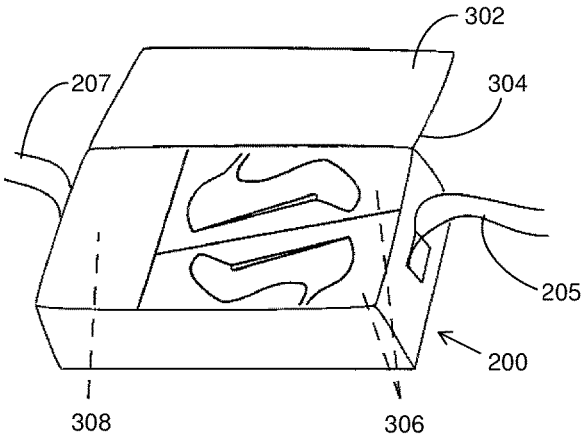
FIG. 3 is a perspective view of the example shoe bag of FIG. 2, showing the inside of the shoe bag.

FIG. 3 shows the inside of the shoe bag 200, according to the present example. Two protective shoe zones 306 separated by one or more protective walls include printed images of shoes in suggested orientation for shoes to be inserted into each of the protective zones 306. A separate compartment 308 can carry accessories or other items in the shoe bag 200.

The lid cover 302 may include a zipper portion 304 along one or more edges of the lid cover 302 that mates with a corresponding zipper portion along one or more top edges of the shoe bag 200. In this way, the lid cover 302 can be attached along the one or more edges of the shoe bag 200, thereby enclosing the inside contents of the shoe bag 200 which are protected from external hazards such as while being carried attached to the existing bag or briefcase 202.

Optionally, provided with the shoe bag 200 is another strap (not shown) that has attachment hardware at its ends. The attachment hardware allow the clips 214 to be easily clipped onto the attachment hardware to allow a user to conveniently carry the shoe bag 200 as a stand-alone personal carrying shoe bag, as may be desired.

Figure 4:
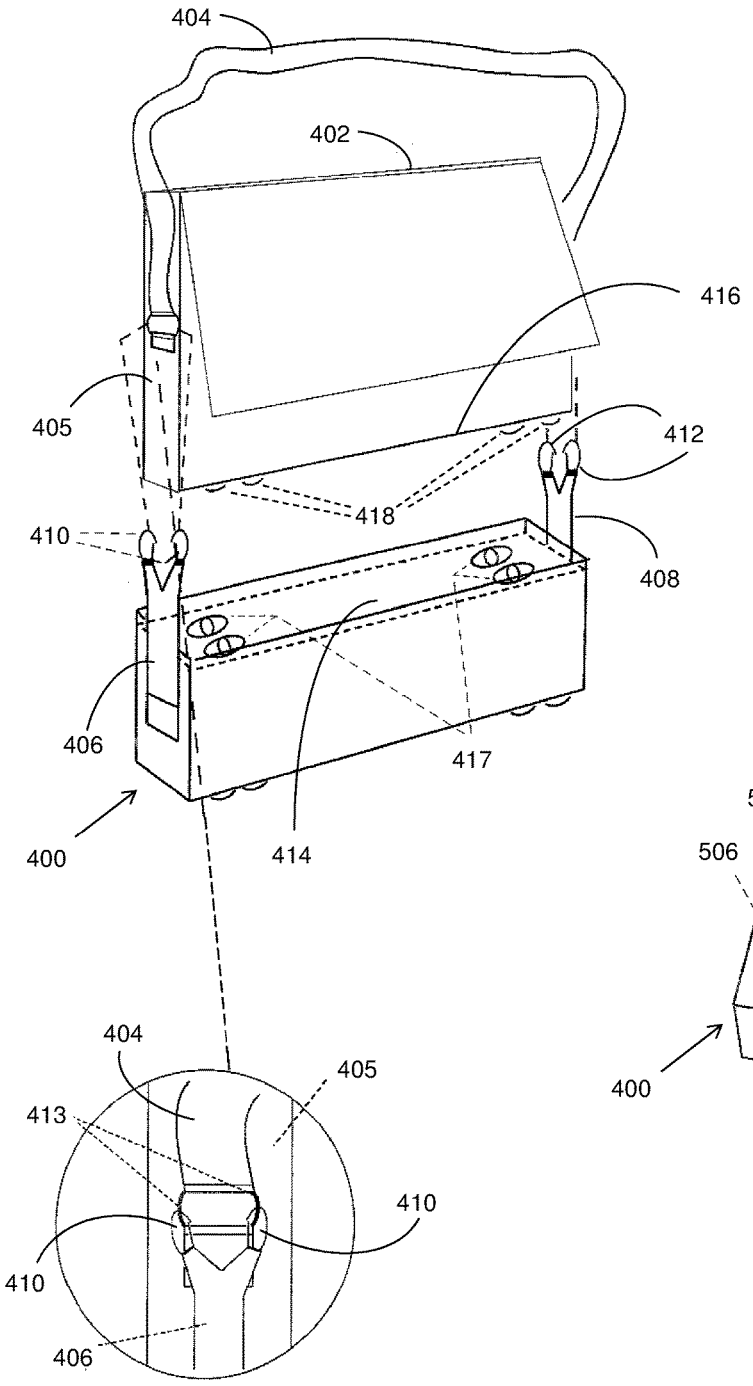
FIG. 4 is a perspective view of an example of a shoe bag that attaches to the bottom of a user's existing bag/briefcase, and with an enlarged view of a region in which the shoe bag is attached to the existing bag/briefcase, according to various embodiments of the present disclosure.

FIG. 4 illustrates an example of a shoe bag 400 suitable for attachment to the bottom side of an existing bag or briefcase 402, according to various embodiments of the present disclosure. The existing bag or brief case 402 includes a strap 404 for carrying the bag or brief case 402.

The shoe bag 400 includes two straps 406, 408, attached to opposing sides of the shoe bag 400. Each of the straps 406, 408, according to various example embodiments, comprises at least one of repurposed automobile seat-belt webbing fabric material, elastic fabric material that allows the each shoe bag strap to stretch and restore in length, or any other suitable material (e.g., leather, cloth, etc.).

The distal ends of the straps 406, 408, include respective locking clips 410, 412, that can be attached (clipped onto) attachment hardware 413 that is part of the ends of the strap 404 of the existing bag or briefcase 402. FIG. 4 shows an enlarged view of one side 405 of the existing bag or briefcase 402 generally where the strap 404 attaches to the side 405. According to certain embodiments, a pair of clips 410 is located on each of the distal ends of the straps 406, 408 to attach to the attachment hardware 413 of the strap 404. The pair of clips 410 on each distal end 406, 408, is arranged to allow each strap 406, 408, to lie flat against the outer side 405 of the existing bag or briefcase 402 and to generally follow a flat orientation of the strap 404 along the outer side 405 of the bag or briefcase 402.

Optionally, each strap 406, 408, of the shoe bag 400 comprises strap-length-adjustment hardware (not shown) that can be manipulated by a user to set a desired length to each strap 406, 408, for a secure interface of the shoe bag with another separate carrying bag or the like. For example, a buckle or clip can be arranged with a portion of the strap 406, 408, such that the portion of the strap can be at least partially wound on the clip and thereby allowing adjustment of the length of the strap 406, 408 by either winding more strap on the clip or releasing some of the strap from the clip. As another option, each strap 406, 408, can comprise elastic fabric material that allows the strap 406, 408 to stretch and restore to original length. The elastic fabric material of the straps 406, 408, for example, can work with the clips 410, 412 clipped onto the attachment hardware 413 of the strap 404 of the existing bag or briefcase 402 to pull the shoe bag 400 upward toward the underside 416 of the existing bag or briefcase 402. In certain embodiments the straps 406, 408, can comprise repurposed automobile seat-belt webbing fabric material, or can comprise any other suitable material for such a strap.

The top of the shoe bag 400, in this example, includes a well portion 414 that is slightly recessed below the perimeter edges of the top of the shoe bag 400 and that is sized and shaped to accept the perimeter of the underside 416 of the existing bag or brief case 402. The underside 416 of the existing bag or briefcase 402 is lowered and received into the recess region of the well portion 414. The top of the shoe bag 400 includes a plurality of circular indents within respective shallower oval indents 417, where the circular indents match the locations of the corresponding feet 418 of the existing bag or briefcase 402. After the existing bag or briefcase 402 is lowered and received into the recess region of the well portion 414, the feet 418 of the existing bag or briefcase 402 mate with the corresponding circular indent in the oval indents 417 in a mating key arrangement. Each of the straps 406, 408, of the shoe bag 400 attaches, via the strap's respective locking clip 410, 412, to attachment hardware at the ends of the strap 404 of the existing bag or brief case 402. The enlarged view of one side 405 of the existing bag or briefcase 402 shows the clips 410 from one strap 406 attached to the attachment hardware 413 of the strap 404. This mating key arrangement mechanically secures and aligns the top outer surface of the shoe bag 400 to the bottom outer surface of the existing bag or brief case 402. The combination of the shoe bag 400 and the existing bag or briefcase 402 can be conveniently carried by a user, such as by hanging the strap 404 on the shoulder or by a handle (not shown) located either at the top of the existing bag or briefcase 402 or on the strap 404.

Figure 5:
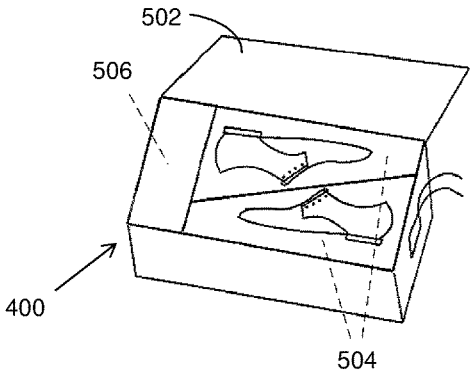
FIG. 5 is a perspective view of the example shoe bag of FIG. 4, showing the inside of the shoe bag.

FIG. 5 shows the inside of the shoe bag 400 with a lid cover 502 rotated away from one or more top edges of the shoe bag 400. The lid cover 502 can include along one or more edges a zipper portion that attaches to a corresponding zipper portion along one or more edges of the top edge of the shoe bag 400. Two shoe protective zones 504 are included in the shoe bag 400. These two shoe protective zones 504 include respective printed images of shoes oriented to visually indicate a suggested orientation of shoes (e.g., toe in first or heel in first) to be inserted into the shoe protective zones 504. An additional compartment 506 may be included in the shoe bag 400 to carry accessories or other items. When the lid cover 502 is rotated onto the edges of the top of the shoe bag 400 and the zipper portions along the one or more edges of the lid cover 502 and the top of the shoe bag 400 are attached together, the shoe bag 400 is closed. When closed, the inside contents of the shoe bag 400 are securely protected from external hazards.

While the discussion above described an example attaching the edges of the lid cover 502 with the corresponding edges of the shoe bag 400 using zippers, it should be understood that other attachment mechanisms could similarly be used in place of the one or more zippers. For example, one or more hook-and-loop strips can be located along one or more edges of the lid cover 502 and can mate with corresponding hook-and-loop strips located along one or more edges of the shoe bag 400. As another example, snaps could be located along the one or more edges of the lid cover 502, which would mate with corresponding mating snaps located along the one or more edges of the shoe bag 400. That is, each of the snaps along the edges of the lid cover 502 can mate with a corresponding snap along the one or more edges of the shoe bag 400, thereby securely closing the shoe bag 400.

Figure 6:
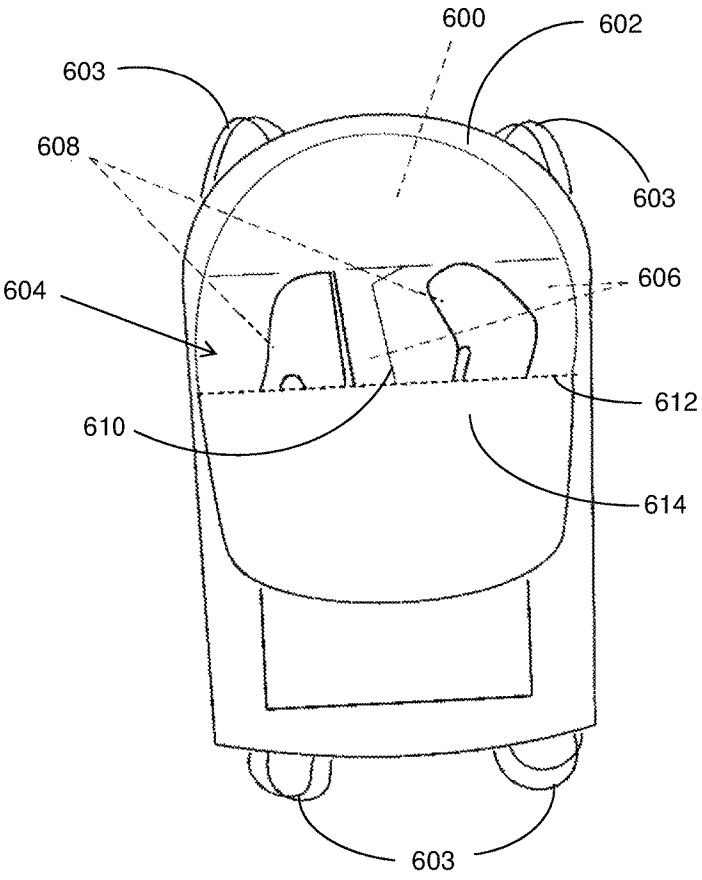
FIG. 6 is a perspective view of an example of a shoe bag integral to a backpack, according to the present disclosure.
Figure 7:
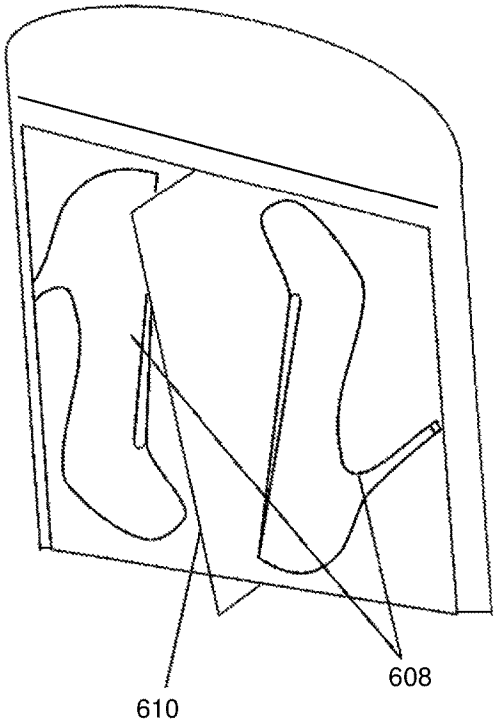
FIG. 7 is a cut-away view of the example shoe bag of FIG. 6 more fully showing the inside of the shoe bag, according to various embodiments of the present disclosure.

FIGS. 6 and 7 illustrate an example of a shoe bag 600 that is integral to a backpack 602, according various embodiments of the present disclosure. The shoe bag 600, according to one example, is integrally attached to the backpack 602 as part of a fabrication process where the shoe bag 600 is stitched sewn onto a side of the backpack 602. The protective shoe zones 606 are integrated as a separate compartment in the backpack 602. It is as if the backpack 602 has two large compartments—one for the protective shoe zones and the other for larger objects such as books and computers.

It should be noted that in alternative embodiments, the shoe bag 600 could be integrally secured to the existing backpack 602 in other ways that allow the shoe bag 600 to be carried along with the backpack 602. For example, one or more hook-and-loop strips (not shown) can be located on one surface of the shoe bag 600. These strips on the shoe bag 600 can mate with corresponding one or more hook-and-loop strips (not shown) located on an adjacent surface of the backpack 602. In various embodiments, the adjacent surfaces in the vicinity of the mating strips are generally flat surfaces parallel to each other. In this way, according to an alternative arrangement, the shoe bag 602 is integral to, while also removably attached to, the backpack 602. The backpack 602 can be used either with or without also carrying the shoe bag 600 along with the backpack 602.

Continuing with the current example shown in FIGS. 6 and 7, the backpack 602 includes one or more carrying straps 603 such that a user can carry the backpack 602 in a convenient way. The shoe bag 600, according to the example, includes a pouch portion 604 that includes two protective shoe zones 606 separated by one or more protective walls 610 that protect shoes that are inserted into the two protective shoe zones 606. Images of shoes 608, which are better visible in FIG. 7, are printed on the inner surface of the protective shoe zones 606. The images of shoes 608 visually indicate to a user of the shoe bag 600 the location of the protective shoe zones 606 to place the shoes therein.

According to various embodiments, the images of shoes 608 are oriented in a suggested orientation for guiding the user to insert each of the shoes into the respective each of the protective shoe zones 606. For example, the orientation of each image of a shoe can be opposite the other image of a shoe. The user is guided by the images of the shoes to insert into the protective shoe zones 606 the shoes in opposite orientations to each other. As another example, which is not shown, the orientation of both images of shoes could be with the front of both shoes aimed substantially toward the same general direction. For example, both shoes can be aimed toward any common direction relative to the shoe bag 600 such as up, down, right, left, front, or back, with each shoe located in a respective one of the protective shoe zones 606. A protective wall 610 separates and maintains the shape of the two protective shoe zones 606. Additionally, a large pocket (not shown) may be included in the shoe bag 600 adjacent to one or more of the protective shoe zones 606 for carrying in the large pocket other items such as items that a commuter might carry. For example, these items could include a computer, books, notebooks, and other supplies. According to one example, the large pocket can be located substantially between both protective shoe zones 606 and the surface of the shoe bag 600 integrally secured to the surface of the backpack 602.

A protective flap 614, according to the example shown in FIG. 6, is rotatably attached along an edge 612 of an outer wall of the shoe bag 600. The flap 614 can be rotatably moved outwardly down from an upper portion of the shoe bag 600. This open position for the flap 614 externally exposes an upper portion of the protective shoe zones 606. The images of shoes 608 are at least partially visible in the exposed protective shoe zones 606 with the flap 614 moved outwardly down away from the upper portion of the shoe bag 600 in the open position. In this arrangement with the protective shoe zones 606 externally exposed, a user can easily insert shoes into the protective shoe zones 606 or remove shoes from the protective shoe zones 606.

According to the example shown in FIG. 6, a user can secure an outer perimeter of the protective flap 614 to the shoe bag 600 along one or more edges of the flap 614 in a closed position forming an enclosure containing the protective shoe zones 606 inside. The flap 614 secured along the outer perimeter to the shoe bag 600, in a closed position, protectively encloses the protective shoe zones 606 and pouch portion 604 inside the shoe bag 600. Shoes located in the protective shoe zones 606, and enclosed in the shoe bag 600 by the flap 614 in the closed position, are protected from damage and external environmental hazards and elements (e.g., rain, snow, dirt, rocks, contaminants, chemicals, etc.) while being transported in the shoe bag 600 along with the backpack 602.

The flap 614 can be secured to the shoe bag 600 along the outer perimeter of the flap 614, in a closed position, in various ways and using various mechanisms. For example, fasteners, such as one or more zippers, pairs of mating hook-and loop strips, and pairs of mating snaps, can be strategically located along the outer perimeter of the flap 614 and a surface of the shoe bag 600.

For example, one or more zipper portions can be attached along one or more edges of the flap 614 and mated with corresponding zipper portions attached along one or more surfaces of the shoe bag 600. The one or more zippers can be zipped closed by a user to form the enclosure with the flap 614 in the closed position. In this way, the flap 614 in the closed position protects shoes inside the shoe protective zones 606 (and optionally also protects items inside the large pocket). The one or more zippers can be zipped open by the user to externally expose the protective shoe zones 606 with the flap 614 in the open position.

As a second example, one or more hook and loop strips can be attached to the flap 614 along one or more edges of the flap 614 and mated with corresponding one or more hook and loop strips attached to one or more surfaces of the shoe bag 600. The pairs of corresponding hook and loop strips can be mated together by a user to form the enclosure with the flap 614 in the closed position. The secure attachment of the protective flap 614 covering the protective shoe zones 606, and in certain embodiments also covering the larger pocket, helps protect shoes placed in the protective shoe zones 606 (and other items in the larger pocket) inside the shoe bag 600.

As a third example, one or more snaps can be attached along one or more edges of the flap 614 and mated with corresponding one or more snaps attached along one or more surfaces of the shoe bag 600. The pairs of corresponding snaps can be mated together by a user to form the enclosure with the flap 614 in the closed position. The pairs of corresponding snaps can be removed from each other by the user to externally expose the protective shoe zones 606 with the flap 614 in the open position.

The illustrations of examples described herein are intended to provide a general understanding of the structure of various embodiments, and they are not intended to serve as a complete description of all the elements and features of apparatus and device that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense. Additionally, unless otherwise specifically expressed or clearly understood from the context of use, a term as used herein describes the singular or the plural of that term.

The terms "a" or "an", as used herein, are defined as one or more than one. The term "plurality", as used herein, is defined as two or more than two. The term "another", as used herein, is defined as at least a second or more. The terms "including" and "having," as used herein, are defined as comprising (i.e., open language). The term "coupled," as used herein, is defined as "connected," although not necessarily directly, and not necessarily mechanically. The term "configured to" describes structure that is adapted to, set up, arranged, commanded, altered, modified, built, composed, constructed, designed, or that has any combination of these characteristics to carry out a given function. The term "adapted to" describes structure that is capable of, able to accommodate, to make, or that is suitable to carry out a given function.

The Abstract is provided with the understanding that it is not intended be used to interpret or limit the scope or meaning of the claims. In addition, in the foregoing Detailed Description, various features are grouped together in a single embodiment to streamline the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The corresponding structures, materials, acts, and equivalents of all means or step plus function elements, if any, in the claims below are intended to include any structure, material, or act for performing the function in combination with other claimed elements as specifically claimed. The description herein has been presented for purposes of illustration and description, but is not intended to be exhaustive or limited to the examples in the form disclosed. Many modifications and variations will be apparent to those of ordinary skill in the art without departing from the scope of the examples presented or claimed. The disclosed embodiments were chosen and described in order to explain the principles of the embodiments and the practical application, and to enable others of ordinary skill in the art to understand the various embodiments with various modifications as are suited to the particular use contemplated. It is intended that the appended claims below cover any and all such applications, modifications, and variations within the scope of the embodiments.

Although specific embodiments of the subject matter have been disclosed, those having ordinary skill in the art will understand that changes can be made to the specific embodiments without departing from the scope of the disclosed subject matter. The scope of the disclosure is not to be restricted, therefore, to the specific embodiments, and it is intended that the appended claims cover any and all such applications, modifications, and embodiments within the scope of the present disclosure.

What is claimed is:

1. A personal carrying bag suitable for carrying at least a pair of personal shoes, comprising:

a shoe bag main body including inside at least two compartments comprising respective two protective shoe zones configured to receive and carry respective two shoes, and a third compartment for storing and protecting from external access objects inside the third compartment, the third compartment being separated by a vertically positioned divider from the two compartments comprising respective two protective shoe zones, each protective shoe zone including on an inner wall of the protective shoe zone an image of a shoe visually indicating where to place each of the two shoes; and at least one shoe bag strap, each shoe bag strap comprising a first end and a second end, the first and second ends respectively attached to at least one side of the personal carrying bag, and wherein the shoe bag main body including a first flap having a flap portion of a first attachment mechanism coupled to an edge of the first flap and a first body portion of the first attachment mechanism coupled to an outer surface of the shoe bag main body, such that when the flap portion of the first attachment mechanism is detached from the first body portion of the first attachment mechanism it releases a portion of the first flap along the edge thereof from the outer surface of the shoe bag main body, the portion of the first flap being released then folds and opens outwardly from the personal carrying bag to form an opening that allows easy access from outside of a side, other than the top side, of the shoe bag main body into the inside of the two protective shoe zones, while the third compartment remains protected from external access by a top flap attached by at least one edge to the shoe bag main body and covering the third compartment that is inside the shoe bag main body to the vertically positioned divider to thereby enclose and protect the third compartment, and wherein the shoe bag main body including the top flap having a flap portion of a second attachment mechanism coupled to an edge of the top flap and a second body portion of the second attachment mechanism coupled to an outer surface of the shoe bag main body, such that when the flap portion of the second attachment mechanism is detached from the second body portion of the second attachment mechanism it releases the top flap to rotate upward from the personal carrying bag to increase the opening formed by the outwardly folded first flap and/or to allow access from outside of the top of the shoe bag main body into the inside of the two protective shoe zones and to allow external access into the third compartment, and wherein first and second vertically positioned shoe compartment dividers form the two protective shoe zones configured to receive and carry respective two shoes, each of the first and second vertically positioned shoe compartment dividers having:

a rear edge that contacts the vertically positioned divider separating the third compartment from the two protective shoe zones, a front edge that contacts with an inner side of the first flap when in a closed position at the side, other than the top side, of the shoe bag main body, a top edge that contacts with an inner side of the top flap when in a closed position at the top of the shoe bag main body, and a front-top corner that contacts the inner side of the first flap when in the closed position at the side of the shoe bag main body and contacts the inner side of the top flap when in the closed position at the top of the shoe bag main body.

2. The personal carrying bag of claim 1, wherein the at least one shoe bag strap comprising first end and second end respectively attached to two opposing sides of the personal carrying bag.

3. The personal carrying bag of claim 1, wherein the each protective shoe zone including on the inner wall of the protective shoe zone an image of a shoe visually indicating an orientation for a shoe when placed in the each protective shoe zone.

4. The personal carrying bag of claim 3, wherein the two protective shoe zones including on the inner wall of one protective shoe zone an image of a shoe oriented opposite the image of a shoe on the inner wall of the other protective shoe zone, the two images of a shoe visually indicating opposite orientation for two shoes to be placed in the respective two protective shoe zones.

5. The personal carrying bag of claim 1, wherein the at least one shoe bag strap comprises repurposed automobile seat-belt webbing fabric material.

6. The personal carrying bag of claim 5, wherein the repurposed automobile seat-belt webbing fabric material includes a webbing fabric material selected from the group of: 7-panel webbing fabric, 3-panel webbing fabric, and 4-panel webbing fabric.

7. The personal carrying bag of claim 1, wherein each inner wall of each protective shoe zone comprises soft material that reduces a possibility of scratching or marring shoes stored in each protective shoe zone.

8. The personal carrying bag of claim 7, wherein an inner wall surface of the each inner wall of each protective shoe zone comprises a soft material selected from the group of: felt, cotton, and real or faux fur.

9. The personal carrying bag of claim 1, wherein the first attachment mechanism comprises any one of:

a first zipper mechanism including a first flap portion of the first zipper mechanism coupled to an edge of the first flap and a first body portion of the first zipper mechanism coupled to an outer surface of the shoe bag main body, such that when the first flap portion of the first zipper mechanism is detached from the first body portion of the first zipper mechanism it releases the portion of the first flap along the edge thereof from the outer surface of the shoe bag main body;

a first hook-and-loop attachment mechanism including a first flap portion of the first hook-and-loop attachment mechanism coupled to an edge of the first flap and a first body portion of the first hook-and-loop attachment mechanism coupled to an outer surface of the shoe bag main body, such that when the first flap portion of the first hook-and-loop attachment mechanism is detached from the first body portion of the first hook-and-loop attachment mechanism it releases the portion of the first flap along the edge thereof from the outer surface of the shoe bag main body; or a first snap attachment mechanism including a first flap portion of the first snap attachment mechanism coupled to an edge of the first flap and a first body portion of the first snap attachment mechanism coupled to an outer surface of the shoe bag main body, such that when the first flap portion of the first snap attachment mechanism is detached from the first body portion of the first snap attachment mechanism it releases the portion of the first flap along the edge thereof from the outer surface of the shoe bag main body.

10. The personal carrying bag of claim 9, wherein the second attachment mechanism comprises any one of:

a second zipper mechanism including a second flap portion of the second zipper mechanism coupled to an edge of the top flap and a second body portion of the second zipper mechanism coupled to an outer surface of the shoe bag main body, such that when the second flap portion of the second zipper mechanism is detached from the second body portion of the second zipper mechanism it releases the top flap to rotate upward from the personal carrying bag to increase the opening formed by the outwardly folded first flap and/or to allow access from outside of the top of the shoe bag main body into the inside of the two protective shoe zones and to allow external access into the third compartment;

a second hook-and-loop attachment mechanism including a second flap portion of the second hook-and-loop attachment mechanism coupled to an edge of the top flap and a second body portion of the second hook-and-loop attachment mechanism coupled to an outer surface of the shoe bag main body, such that when the second flap portion of the second hook-and-loop attachment mechanism is detached from the second body portion of the second hook-and-loop attachment mechanism it releases the top flap to rotate upward from the personal carrying bag to increase the opening formed by the outwardly folded first flap and/or to allow access from outside of the top of the shoe bag main body into the inside of the two protective shoe zones and to allow external access into the third compartment; or a second snap attachment mechanism including a second flap portion of the second snap attachment mechanism coupled to an edge of the top flap and a second body portion of the second snap attachment mechanism coupled to an outer surface of the shoe bag main body, such that when the second flap portion of the second snap attachment mechanism is detached from the second body portion of the second snap attachment mechanism it releases the top flap to rotate upward from the personal carrying bag to increase the opening formed by the outwardly folded first flap and/or to allow access from outside of the top of the shoe bag main body into the inside of the two protective shoe zones and to allow external access into the third compartment.

* * * * *